US011116331B2

(12) United States Patent
Sauer

(10) Patent No.: US 11,116,331 B2
(45) Date of Patent: Sep. 14, 2021

(54) CARRIER CLOTH DEVICE FOR BABIES OR YOUNG CHILDREN

(71) Applicant: Limas GmbH, Kelsterbach (DE)

(72) Inventor: Anna Sauer, Kelsterbach (DE)

(73) Assignee: Limas GmbH, Kelsterbach (DE)

( * ) Notice: Subject to any disclaimer, the term of this patent is extended or adjusted under 35 U.S.C. 154(b) by 0 days.

(21) Appl. No.: 16/383,423

(22) Filed: Apr. 12, 2019

(65) Prior Publication Data

US 2019/0313810 A1 Oct. 17, 2019

(30) Foreign Application Priority Data

Apr. 13, 2018 (DE) ..... 20 2018 102 033.1
Apr. 13, 2018 (EP) ..... 18167317

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
USPC ..... 224/158–160, 643
See application file for complete search history.

(56) References Cited

U.S. PATENT DOCUMENTS 3,783,449 A * 1/1974 Davis ..... F41H 1/02 2/2.5
3,871,562 A * 3/1975 Grenier ..... A47D 13/025 224/160
4,139,131 A * 2/1979 Hathaway ..... A47D 13/025 224/160
4,666,207 A * 5/1987 Quartano ..... B62B 3/144 280/33.992
4,936,495 A * 6/1990 Van de Pol ..... A45F 3/04 112/440
4,986,458 A 1/1991 Linday
4,998,311 A * 3/1991 Ernst ..... A47C 7/021 297/228.1
5,088,747 A * 2/1992 Morrison ..... A61G 5/1043 297/219.1
5,155,869 A * 10/1992 Ralli ..... A41D 27/20 2/247
5,346,419 A * 9/1994 Kaiser ..... B63C 11/08 114/315
5,523,581 A * 6/1996 Cadwalader ..... G21F 3/02 250/519.1

(Continued)

FOREIGN PATENT DOCUMENTS

AT 11673 U1 3/2011
DE 20 2007 006 204 U1 10/2008

(Continued)

*Primary Examiner* — Adam J Waggenspack
(74) *Attorney, Agent, or Firm* — Seed IP Law Group LLP

(57) ABSTRACT

A carrier cloth device for babies or young children comprising a back textile with a back textile inner side and a back textile outer side and at least one textile shoulder strap with a textile shoulder strap inner side and an opposite textile shoulder strap outer side and at least one cushion. The at least one textile shoulder strap is connected to the back textile and comprises a cushion pouch with a pouch opening, wherein the cushion pouch is designed and configured to hold the cushion, and wherein the cushion is insertable into the cushion pouch through the pouch opening and is removable from said pouch.

24 Claims, 8 Drawing Sheets

(56) References Cited

U.S. PATENT DOCUMENTS

| | | | | |
|---|---|---|---|---|
| 5,632,429 | A * | 5/1997 | Cantwell | A45C 13/30 224/264 |
| 6,808,099 | B2 * | 10/2004 | Nykoluk | A45F 3/047 224/262 |
| 7,069,624 | B2 * | 7/2006 | Johnson | F41C 23/02 224/150 |
| 8,225,973 | B1 * | 7/2012 | Beilinson | A45F 3/02 224/257 |
| 2003/0141333 | A1 | 7/2003 | Ammerman | |
| 2004/0060951 | A1 * | 4/2004 | Kelly | A45F 3/14 224/264 |
| 2007/0062987 | A1 | 3/2007 | Murakami | |
| 2010/0072236 | A1 | 3/2010 | Parness et al. | |
| 2011/0226822 | A1 * | 9/2011 | Higuchi | A47D 13/025 224/159 |
| 2011/0240693 | A1 * | 10/2011 | Parness | A47D 13/025 224/160 |
| 2014/0263491 | A1 | 9/2014 | Telford et al. | |
| 2015/0196133 | A1 | 7/2015 | Rosen et al. | |
| 2016/0174628 | A1 * | 6/2016 | Tuffery | A41D 13/0575 2/93 |
| 2018/0168362 | A1 * | 6/2018 | Dorfman | A47C 27/148 |
| 2018/0228247 | A1 * | 8/2018 | Muller | A43B 7/142 |

FOREIGN PATENT DOCUMENTS

| | | | |
|---|---|---|---|
| DE | 20 2015 005 357 | U1 | 10/2015 |
| EP | 2 368 462 | A1 | 9/2011 |
| JP | 3145902 | U | 10/2008 |
| WO | 2005/025383 | A2 | 3/2005 |

* cited by examiner

CARRIER CLOTH DEVICE FOR BABIES OR YOUNG CHILDREN

BACKGROUND

Technical Field

The present disclosure provides carrier cloth devices, such as stomach and back carrier cloth devices, for babies or young children, and a method of use for said devices.

Description of the Related Art

Carrier devices for babies or young children are sufficiently known from the prior art.

DE 20 2007 006 204 U1 relates to a carrier device with a holding body for holding a baby or young child, wherein the holding body is designed such that at least one area of the rear side of a baby or young child is holdable and/or supportable in said holder, wherein the holding body is designed such that its height is adjustable.

DE 20 2015 005 357 U1 discloses a carrier aid for babies and young children, which has a rear panel, two shoulder straps on the upper corners of the rear panel, a hip belt in the textile tunnel, and a head support, wherein the hip belt in the textile tunnel can be affixed in reverse, as a result of which the carrier aid can be worn on both sides.

WO 2005 025 383 discloses a child carrier that can be affixed on the front side or rear side of the torso of a carrier without the harness of the carrier having to be adjusted. The carrier comprises a main panel that generally has a rectangular form. The lower edge of the main panel is connected to the upper edge of a cushioned hip strip, and the lower edge of a head support panel is connected to the upper edge of the main panel. Shoulder straps are connected with the main field and are connected via a chest strap, which is slidably attached to each shoulder strap. Adjustable holders are connected to the chest strap and the head support. An auxiliary hip belt is provided that significantly extends the length of the waistband in order to enable the carrier be worn by a woman during pregnancy.

U.S. Pat. No. 4,986,458 discloses a baby carrier with a carrier pouch for young children and a harness with which the carrier can be worn by an adult. The harness comprises adjustable shoulder straps and an adjustable belt strap, which is disposed such that it enables the carrier pouch to be changed from a position of frontal support to a position of lateral support, while the harness is located on a wearer and the child remains in the pouch. The carrier can also be used to carry a young child on the back of the wearer.

US 2014 263 491 discloses a child carrier with a hip belt, an upper body support, a hammock coupled to the hip belt and the upper body support, and an upper thigh support belt extending on each side of the hammock. Each upper thigh support strap has an inner end section close to the hammock and an outer end section, which is configured for selective coupling with the upper torso support in several positions. When the upper thigh support belts are connected to the upper body support, the hammock and the upper thigh support belts form a seat in order to support a child in an ergonomic spread bent knee position in directions that point inwards and outwards.

AT11673 U1 discloses a carrier aid for babies and young children which consists of a rear part made of material, a head support that is foldable up with two bands, two shoulder straps that are cushioned throughout and that are sewn into the rear part at a specific angle, a chest strap that is sewn into the shoulder straps and that is closable by means of a buckle, and a hip belt pulled through a textile tunnel, wherein the upper third of the rear part is tapered, as a result of which the distribution of the tensile load that is beneficial to the child is achieved over the entire back area.

US 2015 196 133 discloses a baby carrier with a main wall carrier element, two cushioned shoulder strap elements, a stomach belt, a detachable young child insert and a cushioned head support, which can be converted between a front, hip and rear baby carrier.

One disadvantage of the prior art is that systems to date do not sufficiently take into account the different needs of babies and infants or young children. Rather, systems are frequently used that are intended for use for both babies and young children, wherein in both cases, this means only a partial optimization. However, young children are usually much larger and heavier, so that carrier cloth devices for infants are frequently unsuitable for young children.

EP 2 368 462 A1 attempts to address this problem by affixing a hip belt at different heights. A carrier for babies and young children is disclosed, which has a rear part made of material with two shoulder carrier straps, which are attached to the upper corners of the rear part, and can be connected to a hip belt, which can be inserted into one of at least two hip belt textile tunnels that are positioned one on top of the other.

Nevertheless, it has been shown that this adjustability of the hip belt does not yet provide satisfactory adjustment overall, either.

BRIEF SUMMARY

There is accordingly a need to provide a carrier cloth device that is better than the prior art, which is optimally usable for carrying both babies and young children on the stomach and/or back. Further, there is a need to provide a carrier cloth device with improved carrying safety.

Accordingly, the present disclosure provides a carrier cloth device, such as a stomach and back carrier cloth device, for babies and young children, comprising a back textile with a back textile inner side and a back textile outer side, and in some cases a back textile inner layer with a back textile inner side and a back textile outer layer with a back textile outer side, for example wherein the back textile inner layer is disposed opposite the back textile outer layer and/or is connected with said outer layer via edge seams, and at least one textile shoulder strap, in some cases two textile shoulder straps, with a textile shoulder strap inner side and an opposite textile shoulder strap outer side, in some other cases a textile shoulder strap inner layer with a textile shoulder strap inner side and a textile shoulder strap outer layer with a textile shoulder strap outer side, for example wherein the textile shoulder strap inner layer is disposed opposite the textile shoulder strap outer layer and/or is connected with said outer layer via should strap seams, and at least one cushion, wherein the at least one textile shoulder strap is connected to the back textile and comprises at least one cushion pouch with a pouch opening, wherein the cushion pouch is designed and configured to hold the at least one cushion, wherein the cushion is insertable through the pouch opening into the cushion pouch and is removable from said pouch.

The present disclosure further provides a carrier cloth device, such as a stomach and back carrier cloth device, for babies and young children, comprising a back textile with a back textile inner side and a back textile outer side, in some cases a back textile inner layer with a back textile inner side and a back textile outer layer with a back textile outer side, in some cases the back textile inner layer is disposed opposite the back textile outer layer and/or is connected with said outer layer via edge seams, and two textile shoulder straps, each with one textile shoulder strap inner side and an opposite textile shoulder strap outer side, in some cases each with a textile shoulder strap inner layer with a textile shoulder strap inner side and a textile shoulder strap outer layer with a textile shoulder strap outer side, and further comprising at least two cushions, wherein the two textile shoulder straps are connected to the back textile and comprise at least one cushion pouch with a pouch opening, wherein each cushion pouch of the two textile shoulder straps is designed and configured to hold at least one of the cushions, wherein the cushions are insertable through the pouch opening into the cushion pouches and are removable from said pouches. In one design, it is provided that the carrier cloth device comprises precisely two cushions for the two textile shoulder straps.

It has been shown that such a carrier cloth device is suitable for carrying both babies and young children. If the baby or young child becomes too heavy, a cushion can be inserted into the cushion pouch of the at least one textile shoulder strap. The cushion cushions the weight. However, it can also be useful not to insert a cushion in order to guarantee a better grip or better weight distribution when carrying in front of the stomach. The use of the cushion is advantageous when carrying on the back. By contrast, when carrying on the stomach, it has been shown to be advantageous not to use cushions. When carrying under clothing, too, for example under a winter coat, it can be advantageous not to use a cushion. Thus, two states (with and without cushion) of the carrier cloth device can be created, which permits an optimization to the respective requirements.

BRIEF DESCRIPTION OF THE SEVERAL VIEWS OF THE DRAWINGS

Further features and advantages of the present disclosure follow from the examples in the description below, in which exemplary embodiments of the present disclosure with reference to schematic drawings are explained, without limiting the present disclosure as a result.

In the figures.

DETAILED DESCRIPTION

Figure 1:
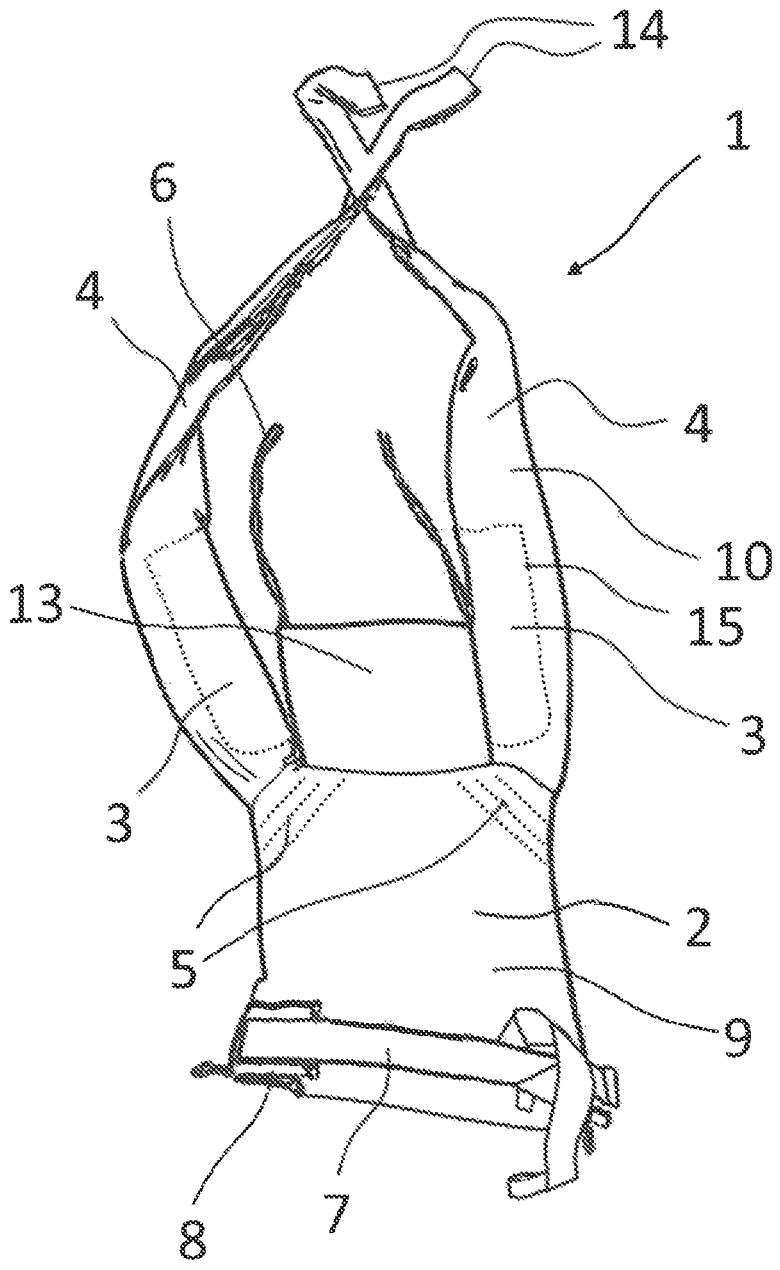
FIG. 1 shows a design of the carrier cloth device according to the present disclosure in a perspective view.

In some cases, the carrier cloth device is a stomach and back carrier cloth device, i.e., the wearer can transport the baby or young child on their stomach or back with the carrier cloth device. The carrier cloth device comprises a back textile for the back of the baby or young child. A carrier cloth device according to the principle of the present disclosure is a carrier aid for babies or young children.

In some cases, the cushion according to the principle of the present disclosure is a shoulder cushion pouch for the shoulders of the carrier of the baby or young child.

In some cases, the cushion pouch according to the principle of the present disclosure is a shoulder cushion pouch for the shoulder of the carrier of the baby or young child. The shoulder cushion pouch can be at a distance apart from the connecting section of not more than 30 cm, in some cases not more than 15 cm.

In at least one design, the term "textile" denotes textile raw materials (natural fibers, chemical fibers) or leather, which are processed to create flat-shaped fabrics (flat fabrics) and as a generic term also denotes cloths and knitted fabrics, such as warp-knitted fabrics, as special forms. In at least one design, the term "cloth" is a generic term for manually or machine-produced woven products such as cloth, silk, velour, plush, terry cloth and other textile fabrics with at least two right-angled or almost right-angled crossed thread systems. Knitted fabric is a textile fabric in which a loop formed by threads is wound into another loop. Warp-knitted fabric is an industrially produced fabric made of a system of threads created from stitch formation on a warp knitting machine. In some cases, the back textile and/or the textile shoulder straps and/or the pouch wall comprises such a textile, in some other cases such a cloth or such a knitted fabric, and in some further cases such a cloth and/or warp-knitted fabric.

In some cases, the at least one textile shoulder strap is partially or predominantly or entirely designed at least with two layers, in some further cases with precisely two layers, wherein the textile shoulder strap inner side is formed by a textile shoulder strap inner layer and the textile shoulder strap outer side is formed by a textile shoulder strap outer layer. In some cases, the at least one textile shoulder strap is partially or entirely designed at least with two layers, wherein the textile shoulder strap inner layer has the textile shoulder strap inner side and the textile shoulder strap outer layer has the textile shoulder strap outer side. In some other cases the textile shoulder strap inner layer lies opposite the textile shoulder strap outer layer and in some further cases is in contact with it at least in sections.

The textile shoulder strap inner side and the textile shoulder strap outer side can, in an alternative design, also be opposite sides of a single-layer textile shoulder strap, for example wherein no textile shoulder strap inner layer and textile shoulder strap outer layer are in this case provided, but instead, only a textile shoulder strap overall layer. The single-layer textile shoulder strap overall layer is in some cases designed in the same way as is described for the textile shoulder strap outer layer. In this design, the cushion pouch in some cases comprises a pouch wall, which is sewn onto the textile shoulder strap overall layer, in some other cases on the textile shoulder strap inner side.

In some cases, the back textile is at least two-layered, wherein the back textile inner side is formed by a back textile inner layer and the back textile outer side is formed by a back textile outer layer. In some other cases the back textile inner layer lies opposite the back textile outer layer and in some further cases is in contact with it at least in sections, for example wherein circumferential edge seams connect the back textile inner layer with the back textile outer layer.

In one advantageous design, it can be provided that the back textile comprises at least one connecting section, in some cases two connecting sections, with which the at least one textile shoulder strap, in some cases the two textile shoulder straps, are connected, such as sewn, wherein the at least one textile shoulder strap extends into the at least one connecting section and has at least one Z-shaped fold there, which is at least partially disposed, such as sewn in, at least partially between the back textile inner layer and the back textile outer layer. This has several advantages. The at least one Z-shaped fold is an area in which the textile shoulder strap is reinforced. It has further been shown that the at least one connecting section can be smaller in terms of surface area, which reduces the risk that said connecting section cuts into the head of the baby or young child or presses the carrier of the baby or young child too much against the neck. Further, the field of vision of the baby is less restricted. However, at the same time, a broad shoulder strap is advantageous in order to more evenly distribute the load and reduce the risk of sliding off. Without cushioning, the carrier aid has also been shown to be suitable for carrying on the hip.

In some cases the at least one textile shoulder strap has a first strap section in which the textile shoulder strap is connected with the back textile, wherein the first strap section has at least one fold, in some cases at least one Z-shaped fold, and/or one first average width, in some other cases two or three Z-shaped folds. This can here be the same at least one Z-shaped fold that is disposed, such as sewn in, at least partially between the back textile inner layer and the back textile outer layer, wherein the at least one Z-shaped fold is in some cases disposed, such as sewn in, not only between the back textile inner layer and the back textile outer layer, but also extends beyond it. The first strap section is in some cases disposed, such as sewn in, partially between the back textile inner layer and the back textile outer layer, and extends with the remaining part beyond the back textile inner layer and the back textile outer layer, in some cases wherein the second strap section adjoins the first strap section. In the area of the first strap section with the at least one Z-shaped fold, the textile shoulder strap is in some cases narrower than the average second width of the second strap section, so that even with a comparatively small connecting section, an overall broad textile shoulder strap can be used.

Surprisingly, the at least one Z-shaped fold can be combined with the cushion pouch without making it harder to insert a cushion. It could be anticipated that the Z-shaped folds could distort the geometry of the cushion pouch so that the cushion is not insertable. However, it was surprisingly shown that this is not the case, for example when the textile described below is used.

In some cases, it is provided that the at least one textile shoulder strap has a second strap section in which the textile shoulder strap has a constant and/or average second width, in some other cases the cushion pouch is present in this second strap section. In some cases, the cushion pouch extends fully within the second area, i.e., in some advantageous cases not until into the first or third area. In one design, the second strap section adjoins the first and/or third strap section, e.g., so that it is present between the first and third strap section. The textile shoulder strap has a constant second width when the width of the textile shoulder strap only changes insignificantly in the second strap section, in some cases, the remaining changes to the width are only the result of production or can be traced back to the inherent unevennesses of the textile.

In some cases, it is provided that the at least one textile shoulder strap has a third strap section, in some other cases the third strap section described above, and in some further cases in which the textile shoulder strap tapers, for example in the direction of the end of the textile shoulder strap. In some even further cases, in the third strap section, the textile shoulder strap has a third width in at least one place, which is smaller and/or larger than the average and/or constant second width of the textile shoulder strap in the second strap section, in some cases at least one place with a smaller third width and at least one second place with a larger third width than the second width of the second strap section. Alternatively, or in addition, the textile shoulder strap in the third strap section has at least one area or is one area in which the third strap section comprises fewer layers than the second strap section and/or is formed of a single layer. In some cases, said area is broader than said average and/or constant second area of the second strap section, in some cases 50% to 150%, in some other cases 70% to 100% broader than the average and/or constant second width of the second strap section. In one design, the third strap section has a separation, in some cases a separating seam, in which the textile shoulder strap inner layer and/or the textile shoulder strap outer layer is separated, for example in the area of the third strap section, in some cases such that a larger average third width is obtained in the third strap section as the constant and/or average second width of the second strap section. In some cases, the third strap section forms a single-layer textile shoulder strap overall layer beyond the separating seam, which is connected as a single piece with the textile shoulder strap inner layer and the textile shoulder strap outer layer. It has been shown that such a strap section is better suited to fan out below the bottom of a baby or young child and thus to achieve optimum weight distribution.

In some cases, it is provided that the first strap section has a first average width, the second strap section has a second average width and the third strap section has a third average width, wherein the first average width is smaller than the second and/or third average width. In some other cases, the second average width of the second strap section corresponds to a constant average width of the second strap section.

In some cases, it is provided that the textile shoulder strap inner side is formed by a textile shoulder strap inner layer and the textile shoulder strap outer side is formed by a textile shoulder strap outer layer, wherein the cushion pouch has at least one pouch wall, which is formed by the textile shoulder strap inner layer and/or the textile shoulder strap outer layer, for example wherein the cushion pouch is bounded by—aside from the pouch opening—entirely or partially circumferential pouch seams, which connect the textile shoulder strap inner layer and the textile shoulder strap outer layer. It has been shown that this enables a good incorporation of the cushion, in some cases so that the cushion causes no injuries to the skin of the wearer.

The at least one textile shoulder strap is described above and below. In some cases, this is two textile shoulder straps, which each have the properties of the at least one textile shoulder strap. In some further cases these have a mirror-image structure. In some cases, the carrier cloth device comprises at least one textile shoulder strap in the form of precisely two textile shoulder straps, in some cases wherein these are a left-hand and a right-hand textile shoulder strap and are connected via a left-hand and a right-hand connecting section with the back textile, in some cases as described above.

In some designs, it is provided that the pouch opening of the at least one textile shoulder strap has a first and second opening edge, wherein the first opening edge is formed by a turned over section of the textile shoulder strap outer layer or of the textile shoulder strap inner layer and the second opening edge is formed by a turned over section of the textile shoulder strap outer layer or of the textile shoulder strap inner layer, in some cases wherein the first opening edge is formed by a turned over section of the textile shoulder strap outer layer and the second opening edge is formed by a turned over section of the textile shoulder strap outer layer or of the textile shoulder strap inner layer.

In some cases, the pouch opening is formed by a slit with a slit length, for example wherein the slit length is defined by, in some cases terminal, slit seams, for example wherein the slit seams run orthogonally to the slit. A slit-shaped pouch opening makes it possible to insert the cushion by expanding the slit.

In some cases, it is provided in this case that the slit is formed entirely or partially by an, for example monoelastic, textile, which has in a first direction an inherent first expandability and/or first elasticity and in a second direction has an inherent second expandability and/or second elasticity, wherein the second expandability and/or second elasticity is less than the first expandability and/or first elasticity, in some cases the textile forming the slit is oriented such that the slit has a maximum longitudinal extension in the first direction. A slit with monoelastic textile can be expanded in one direction, but also has the necessary rigidity to remain independently closed. Although bielastic textile areas can also form slits, these have not been shown to be equally dimensionally stable. In one design, the textile has a maximum first expandability and/or first elasticity in the first direction and/or the first direction is orthogonal to the second direction. It has further been shown that the slit requires no closure system, such as a zip, pressure or shank button to remain closed. In some cases, it is provided in one design that the opening of the slit is opened solely by expanding the opening edges, in some other cases, no mechanical closure is present in the form of a zip, pressure or shank button or Velcro fastening. And, in some further cases, the opening of the slit closes independently, advantageously through pulling together of the, in some cases monoelastic, textile in the area of the slit. The slit is in some cases elastically expandable, but draws together after the force is no longer effective. It has been surprisingly shown that this makes an unintentional opening of the cushion more difficult, and at the same time, it is reliable, without the risk of causing injury to the young child or baby by a mechanical closure.

In some cases, it is provided that the pouch opening is formed in the textile shoulder strap outer side or between the textile shoulder strap outer side and the textile shoulder strap inner side, in some cases between the textile shoulder strap inner layer and the textile shoulder strap outer layer. A pouch opening in the textile shoulder strap inner side is possible, but has been shown to be uncomfortable. By contrast, a pouch opening in the textile shoulder strap outer side is rather practical, since this way, easy accessibility is guaranteed. In some other cases, in a further design, the pouch opening is formed between the textile shoulder strap outer layer and the textile shoulder strap inner layer, for example on an interior shoulder strap edge. This enables an even textile shoulder strap outer side and textile shoulder strap inner side. Additionally, it has been surprisingly shown that the pressure of the baby or young child contributes to a closure of the pouch opening, wherein the textile shoulder strap outer layer is pressed onto the textile shoulder strap inner layer and the slit edges are also drawn together. The cushion can then not fall out during carrying and the carrier must be removed in order to replace the cushion.

In one advantageous design, it is provided that the at least one textile shoulder strap has an inner shoulder strap edge and an outer shoulder strap edge, wherein the textile shoulder strap inner side and the textile shoulder strap outer side extend between the inner shoulder strap edge and the outer shoulder strap edge, wherein the inner shoulder strap edge is positioned closer to the neck of the wearer with the generic use of the textile shoulder strap than the outer shoulder strap edge. In some cases, the pouch opening is present on the inner shoulder strap edge and/or the textile shoulder strap inner side is connected as a single piece with the textile shoulder strap outer side, for example the textile shoulder strap inner layer is connected as a single piece on the shoulder strap edge with the textile shoulder strap outer layer. It has been shown that a pouch opening on the inner side shoulder strap edge is less impaired by dirt. A single piece connection between the textile shoulder strap inner layer and the textile shoulder strap outer layer has the advantage that a friction of the neck on the seam is better prevented, wherein with this design, it is advantageous when the pouch opening is present within the textile shoulder strap outer layer instead of between the textile shoulder strap inner layer and the textile shoulder strap outer layer. When the pouch opening is present between the textile shoulder strap inner layer and the textile shoulder strap outer layer, it is advantageous when it is also present on the inner shoulder strap edge. The width of the shoulder straps or shoulder strap sections is in some cases defined by the distance between the inner and outer shoulder strap edge.

In some cases, the cushion pouch is designed and configured to hold the cushion, wherein the cushion pouch encloses the cushion on all sides and is in contact with it and/or the cushion pouch, when in an expanded state, has inner dimensions that essentially correspond to the dimensions of the cushion. In one suitable design, the cushion pouch has a basic form that corresponds to the basic form of the cushion, such as a rectangular basic form. It has been shown to be advantageous when the cushion pouch is designed and configured to enclose the cushion on all sides and to be in contact with it. This prevents the cushion from sliding out of position in the cushion pouch.

In some cases, it is provided that the textile shoulder strap comprises a textile strip which extends essentially parallel to the cushion pouch and has an average width of at least 2 cm, in some cases of at least 3 cm, in some other cases 3.5 to 7 cm, and in some further case said textile strip forms a section of the outer shoulder strap edge. The textile strip reduces the risk of the cushion sliding off the shoulder and improves safety.

In some cases, the, for example essentially rectangular, back textile has an average length and/or an average width and/or a first maximum longitudinal extension. In some further cases, the average width is less than the average length and these are determined orthogonally to each other. The first maximum longitudinal extension can usually be determined by a corner of the back textile in relation to a diagonally opposite corner of the back textile. In this case, it is advantageous when the at least one textile shoulder strap has a second maximum longitudinal extension and/or average textile shoulder strap length which is at least double or at least triple the size of the first maximum longitudinal extension. Often, the second maximum longitudinal extension essentially corresponds to the average textile shoulder strap length of the textile shoulder strap. In one design, the second maximum longitudinal extension is at least 200%, in some cases 250 to 600%, in some other cases 270 to 400%, of the first maximum longitudinal extension. In one design, the average textile shoulder strap length is at least 200%, in some cases 250 to 600%, and in some other cases 270 to 400%, of the first maximum longitudinal extension.

In some cases, the at least one textile shoulder strap is affixed on a first end with a connecting section of the back textile, such as the connecting section described above, and a second end of the at least one textile shoulder strap is exposed, for example unconnected.

In some cases, the cushion has an essentially rectangular form with four corners. Such cushions have been shown to be suitable. In some further cases, the cushion has a cushion length and a cushion width, wherein the cushion length is longer than the slit length of the slit. In one advantageous design, it is provided that the cushion has a cushion length and a cushion width, wherein the cushion width is less than the cushion length, and greater than the slit length of the slit in the pouch opening. In some other cases the cushion comprises the second cushion seam described below. This effectively prevents an unintentional removal of the cushion.

In some cases, the cushion and/or the cushion pouch have an essentially rectangular form with four corners, wherein one or two of the corners are more strongly rounded than the remaining corners, for example one or two more strongly rounded corners of the cushion pouch are disposed closer on the outer shoulder strap edge than on the inner shoulder strap edge. Here, the position of the cushion is pre-defined. This has the advantage that the cushion does not change its position in the cushion pouch, which improves the adjustment of the cushion to the wearer.

In some cases, it is provided that the pouch opening is predominantly or solely formed from or consists of textile materials, such as the textiles described in the introduction, in some cases with the exception of the slit seams. This reduces the risk of injury and, surprisingly, no mechanical closure means are required. In some other cases the at least one shoulder strap and/or the pouch opening is essentially fully formed from textile and/or deformable materials, such as wherein it comprises no hard elements such as zips or buttons. It has surprisingly been shown that the cushion pouches securely enclose the cushion without such closure means when the construction of the cushion pouch described is used. This improves safety, since babies or young children can injure themselves on zips or buttons and these are also uncomfortable upon contact.

In some cases, the pouch opening has a maximum longitudinal extension which extends essentially parallel to the longitudinal extension of the shoulder strap and/or to the inner and/or outer shoulder strap edge. It has been shown that here, the slit remains better closed while carrying. The tensile forces created by the baby or young child thus act essentially parallel, and not orthogonal, to the slit, so that the slit is not extended. This improves the closure of the cushion pouch during carrying.

Further, in some further cases the carrier cloth device comprises a hip belt. In some other cases the back textile comprises at least one textile tunnel for the hip belt, wherein the textile tunnel is in some cases a tube comprising or consisting of textile, through which the hip belt can be guided. The hip belt in some cases comprises at least one mechanical closure element for connecting the ends. The textile tunnel is in some cases attached on one, in some further cases to the lower, end of the back textile, lying opposite the at least one connecting section. The hip belt can be reinforced with a hip cushion in sections.

The carrier cloth device can further comprise a head support for the young child, which is connected to the back textile, in some cases between two connecting sections for two textile shoulder straps.

In one design, the carrier cloth device and/or the at least one textile shoulder strap are formed mainly from a textile that consists by more than 65 weight %, in some cases at least 85 weight %, and in some other cases at least 98 weight %, of fibers, such as natural fibers, wherein the fibers are selected from a group consisting of cotton, linen, hemp, animal wool and silk, and advantageously cotton and/or linen. In some other cases, the carrier cloth device consists predominantly of a textile which has a grammage of 50 to 400 g/m$^2$, in some cases 100 to 300 g/m$^2$, in some other cases 150 to 250 g/m$^2$. The grammage and material has also been shown to be suitable for the back, the at least one pouch wall, and/or the at least one textile shoulder strap of the carrier cloth device.

Further, it is provided in one design that the cushion comprises a textile shell surrounding a cushion material, in some cases a cushion material comprising foam, and in some other cases the textile shell is formed at least in sections from the same material as the at least one textile shoulder strap, for example the pouch wall, and/or the back textile, and in some further cases the textile shoulder strap and the pouch wall. It has been shown that signs of wear and tear are low when such materials are used for the cushion and the textile shoulder strap, for example the pouch wall. If a textile is finer or rougher than the other textile, this can create intensified wear and tear. In some other cases, the pouch wall is predominantly or entirely formed from the same material as the back textile and/or the cushion material and/or the remaining textile shoulder strap.

Further, in some cases, the cushion comprises a first cushion side and an opposite second cushion side, wherein the first and second cushion side are connected on a circumferential cushion edge by a first cushion seam and/or wherein at least one second cushion seam connects the first cushion side and the second cushion side and this second cushion seam extends from a section or from a direction of a section of the circumferential cushion edge through to the opposite section or in the direction of the opposite section of the circumferential cushion edge, in some cases at a distance apart from the cushion edges that essentially extend in parallel, in some other cases the at least one second cushion seam punctures the cushion material, e.g., in contrast to the first cushion seam. In at least one design, the at least one second cushion seam extends essentially parallel and at a distance apart from two first cushion edges and between two second cushion edges, wherein the first cushion edges are terminally connected to the second cushion edges and the two first cushion edges are each longer than the two second cushion edges. One advantage of the at least one second cushion seam is that the cushion can more easily be folded along said second cushion seam. This makes it easier to introduce the cushion into the pouch opening, for example wherein the slit length of the pouch opening is smaller than the cushion width and/or the length of the second cushion edges. In some cases, the cushion has an average cushion width, an average cushion length and an average cushion thickness, wherein the average cushion thickness is less than the average cushion width, and the average cushion width is less than the average cushion length.

In some cases, it is provided that the cushion comprises a second cushion seam, which compresses the cushion, at least in sections, e.g., the foam in the cushion, and in some cases generates a recess in the cushion surface which extends along the second cushion seam. This stabilizes the cushion.

Two linear elements in some cases extend "essentially parallel" in relation to each other, according to the principle of the present disclosure, when the deviation of a precise parallel alignment in relation to each other of the two linear elements is less than 15°, in some cases less than 10°, and in some other cases less than 5°.

The present disclosure further relates to the use of the carrier cloth device for transporting babies or young children, in some cases on the back or stomach or on the hip of a wearer. The term "wearer" according to the principle of the present disclosure applies to a male or female user of the carrier cloth device for carrying babies or young children.

In some cases, the present disclosure relates to the use of the carrier cloth device for transporting babies or young children on the stomach, wherein the back textile lies on the back and/or bottom of the baby or young child and two textile shoulder straps are guided from the direction of the ribcage of a wearer carrying the baby or young child on their stomach using the carrier cloth device, over the shoulders of the wearer along the back, in some cases over the sacrum, to the stomach of the wearer and below the bottom of the young child, in some cases are knotted there on the stomach of the wearer and/or are again guided, in some further cases over the sacrum to the back of the wearer and are knotted on the back of the wearer.

In some cases, the present disclosure relates to the use of the carrier cloth device for transporting babies or young children on the back, wherein the back textile lies on the back and/or bottom of the baby or young child and two textile shoulder straps are guided from the direction of the back of a wearer carrying the baby or young child on their back using the carrier cloth device, over the shoulders of the wearer, below the armpits of the wearer back in the direction of the back and below the bottom of the young child, are crossed there and guided to the stomach of the wearer and are knotted on the stomach of the wearer or below the bottom of the young child on the back.

With the present disclosure, an improved carrier cloth device is provided which is quickly and easily manually optimizable by the wearer for carrying both babies and young children on the stomach, hip or back. It has been shown that replaceable cushions can be used for this purpose, and that these can be safely and reliably integrated without mechanical aids. Here, safe wearing of the carrier cloth device is enabled in which the textile shoulder straps neither chafe nor injure the baby or young child, and at the same time, a sliding off of the textile shoulder straps is reliably prevented. This significantly improves wearing comfort and safety.

FIG. 1 shows an inner view of a design of the carrier cloth device 1 for babies or young children, comprising a back textile 2 with a back textile inner side 9 and two textile shoulder straps 4, each with a shoulder strap inner side 10, wherein the two textile shoulder straps 4 are connected to the back textile 2 and each comprise a cushion pouch 3. The cushion pouch 3 is designed and configured to hold a cushion, which is removable. In this design, the Z-shaped folds are not shown. The carrier cloth device 1 comprises a hip belt 7, which is partially underlaid with a hip cushion 8. The back textile 2 comprises at least one connecting section 5, with which the at least one textile shoulder strap 4 is connected, presenting two connecting sections 5, which are each connected with one of the two textile shoulder straps 4. Here, the cushion pouch 3 has a pouch wall, which is bound by partially circumferential pouch seams 15, which connect a textile shoulder strap inner layer and a textile shoulder strap outer layer. The two textile shoulder straps 4 taper in the direction of the ends 14 of the two textile shoulder straps. The carrier cloth device 1 comprises a head support 13 with head support belt 6 for protection against the sun and to support the child's head, for example when sleeping.

Figure 2:
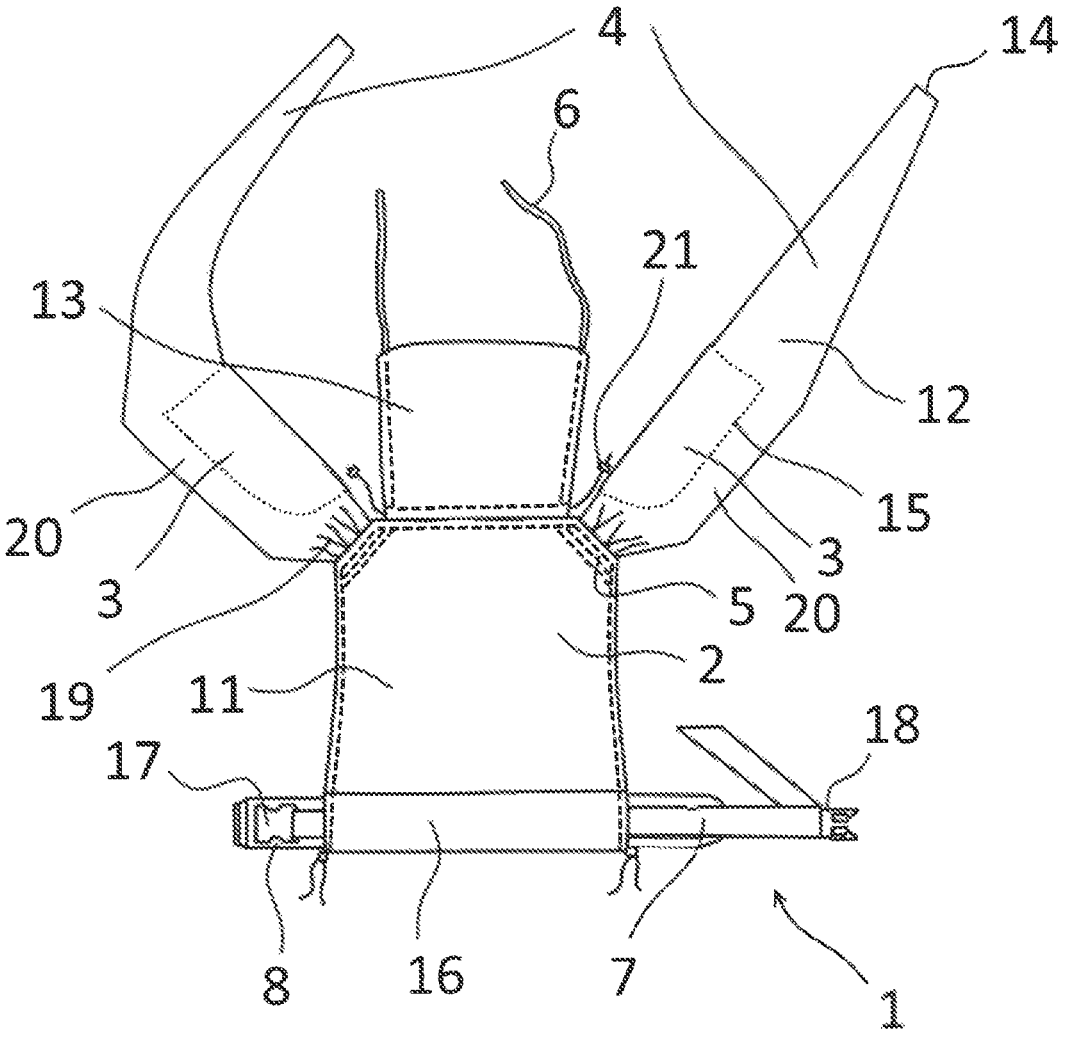
FIG. 2 shows a schematic view of a further design of the carrier cloth device according to the present disclosure.

FIG. 2 shows an outer view of a design of the carrier cloth device 1 for babies or young children, comprising a back textile 2 with a back textile outer side 11 and two textile shoulder straps 4 each with a shoulder strap outer side 12, wherein the at least one textile shoulder strap 4 is connected to the back textile 2 via a connecting section 5 and comprises a cushion pouch 3, wherein the cushion pouch 3 is designed and configured to hold a cushion, and wherein the cushion is removable. Here, the cushion pouch 3 has a pouch wall, which is bound by partially circumferential pouch seams 15, which connect a textile shoulder strap inner layer and a textile shoulder strap outer layer. The carrier cloth device 1 comprises a hip belt 7, which is partially underlaid with a hip cushion 8. The hip belt 7 and the hip cushion 8 are guided through a textile tunnel 16 and the ends of the hip belt 7 are connectable with mechanical closure means 17, 18. The carrier cloth device 1 comprises a head support 13 with a head support belt 6 for supporting the child's head and closing loops 21 for the head support 13. A Z-fold 19 is partially visible, wherein a portion is covered by the textile of the connecting section 5. The two textile shoulder straps 4 each comprise a textile strip 20, which extends essentially parallel to the cushion pouch 3 and which has an average width of at least 2 cm. The two textile shoulder straps 4 taper in the direction of the ends 14 of the two textile shoulder straps.

Figure 3:
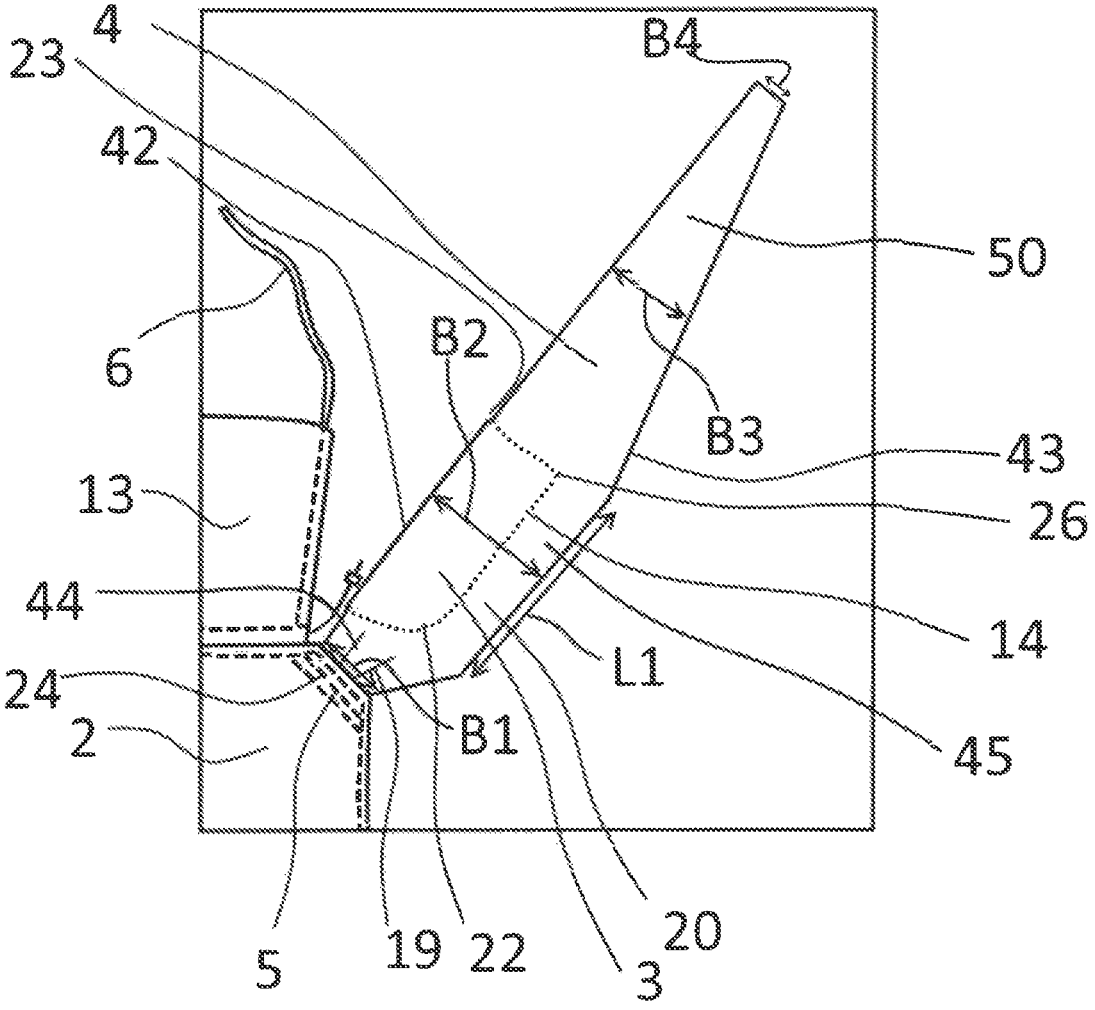
FIG. 3 shows a section of the schematic view from FIG. 2.

FIG. 3 shows a cross-section of the scheme from FIG. 2. One of the two textile shoulder straps can be seen, wherein this has a first strap section 44, in which the textile shoulder strap 4 is connected to the back textile 2. The first strap section 44 has at least one fold 19, the at least one textile shoulder strap 4 has a second strap section 45 in which the textile shoulder strap 4 has a constant second width B2, and the cushion pouch 3 is present in this second strap section 45. The connecting section 5 has connecting section seams 24, which affix a section of the folds 19. The second strap section 45 has a length L1 which is greater than the length of the cushion pouch (see FIG. 6). In the first strap section, there is a minimum first width B1, which is less than the constant second width B2. The textile shoulder strap 4 tapers in the direction of the ends in a third strap section 50 and has a third width B4 on said end. Halfway between said end and the second strap section 45, it has a third width B3.

The textile shoulder strap 4 comprises a textile strip 20 which extends essentially parallel to the cushion pouch 3. The carrier cloth device 1 comprises a head support 13 with head support belt 6 for protection against the sun and to support the child's head, for example when sleeping. It is also provided that the at least one textile shoulder strap 4 has an inner shoulder strap edge 42 and an outer shoulder strap edge 43, wherein the textile shoulder strap inner side and the textile shoulder strap outer side extend between the inner shoulder strap edge and the outer shoulder strap edge. Here, the cushion pouch 3 has an essentially rectangular form with four corners, wherein one or two of the corners 22 are more strongly rounded than the remaining corners 23, 26, in some cases one of the rounded corners 22 of the cushion pouch 3 which are disposed closer to the outer shoulder strap edge 43 than the inner shoulder strap edge 42.

Figure 4:
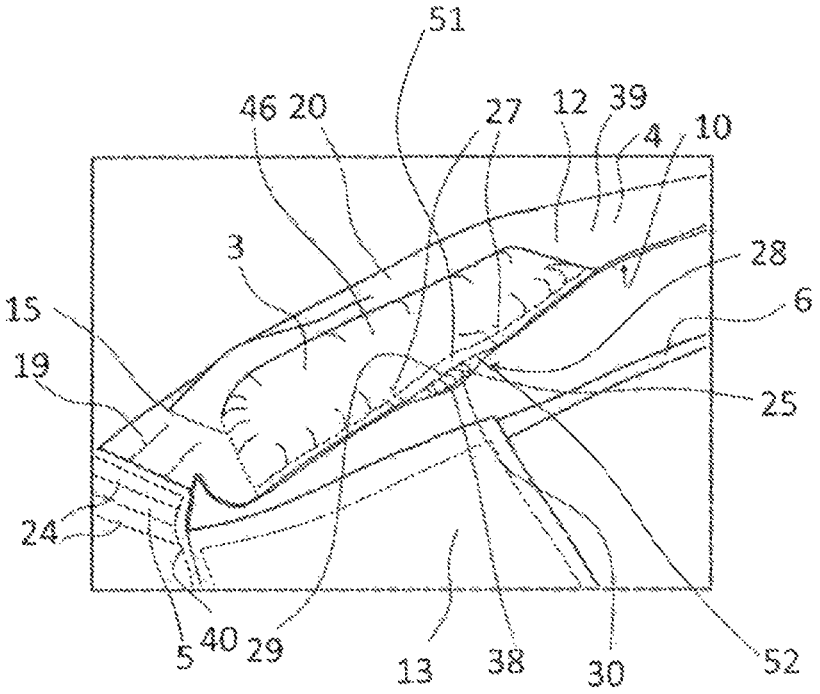
FIG. 4 shows a possible design of a cushion pouch with cushion for the carrier cloth device according to the present disclosure in a perspective view.

FIG. 4 shows an area of a carrier cloth device comprising a textile shoulder strap 4 with a textile shoulder strap inner side 10 and an opposite textile shoulder strap outer side 12, and at least one cushion 25 lying between them. The cushion 25 is present in the cushion pouch 3 and the cushion pouch is bound by at least one pouch wall 46. The cushion 25 is removable from the cushion pouch 3 via the pouch opening 28. The textile shoulder strap outer layer 39 comprises the textile shoulder strap outer side 12 and the textile shoulder strap inner layer 38 comprises the textile shoulder strap inner side 10. The pouch opening 28 has a first and second opening edge 29, 30, wherein the first opening edge 29 is formed by a turned over section of the textile shoulder strap outer layer 39 and the second opening edge 30 is formed by a turned over section of the textile shoulder strap inner layer 38.

The connecting section 5 has connecting section seams 24, which affix a section of the folds 19. Here, the cushion pouch 3 has a pouch wall 46, which is bound by a partially circumferential pouch seam 15, and which connects a textile shoulder strap inner layer 38 and a textile shoulder strap outer layer 39. The pouch seam is only partially visible, since the arched cushion pouch largely covers it. The textile shoulder strap 4 comprises a textile strip 20 which extends essentially parallel to the cushion pouch 3.

The pouch opening 28 is formed by a slit, wherein the slit length is defined by slit seams 27, which run orthogonally to the slit. An additional edge seam 40 connects the layers of the back textile on the edge. The carrier cloth device 1 comprises a head support 13 with head support belt 6 for protection against the sun and to support the child's head, for example when sleeping. The pouch opening 28 is formed between the textile shoulder strap inner side 10 and the textile shoulder strap outer side 12, in some cases between the textile shoulder strap inner layer 38 and the textile shoulder strap outer layer 39.

Figure 5:
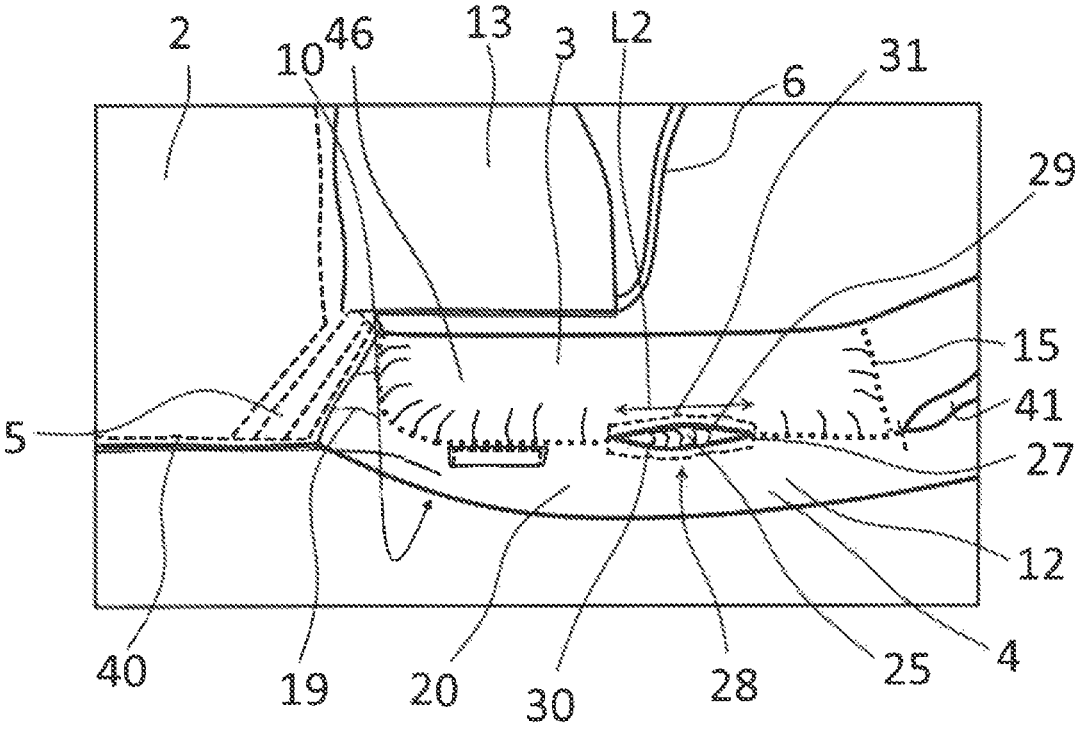
FIG. 5 shows a possible alternative design of a cushion pouch with cushion for the carrier cloth device according to the present disclosure in a perspective view.

FIG. 5 shows an area of a carrier cloth device comprising a textile shoulder strap 4 with a textile shoulder strap inner side 10 and an opposite textile shoulder strap outer side 12, and at least one cushion 25 lying between them. The cushion 25 is present in the cushion pouch 3 and the cushion pouch is bound by at least one pouch wall 46. The cushion 25 is removable from the cushion pouch 3 via the pouch opening 28. The textile shoulder strap outer layer comprises the textile shoulder strap outer side 12 and the textile shoulder strap inner layer comprises the textile shoulder strap inner side 10.

The pouch opening 28 has a first and second opening edge 29, 30, wherein the first opening edge 29 is formed by a turned over section of the textile shoulder strap outer layer and the second opening edge 30 is also formed by a turned over section of the textile shoulder strap outer layer. The connecting section 5 of the back textile 2 is connected to the edge seam 40. Here, the cushion pouch 3 has a pouch wall 46, which is bound by a partially circumferential pouch seam 15, and which connects a textile shoulder strap inner layer and a textile shoulder strap outer layer. The textile shoulder strap 4 comprises a textile strip 20 which extends essentially parallel to the cushion pouch 3. The pouch opening 28 is formed by a slit, wherein the slit length L2 is defined by slit seams 27, which run orthogonally to the slit. Additionally, slit seams 31 are also present which run essentially parallel to the slit. On the other side of the cushion pouch 3, the textile shoulder strap outer layer has a separation 41, such as a separating seam, wherein the textile shoulder strap outer layer and the textile shoulder strap inner layer can here be unfolded. The carrier cloth device 1 comprises a head support 13 with head support belt 6 for protection against the sun and to support the child's head, for example when sleeping. The pouch opening is formed within the textile shoulder strap outer side 12, in some cases in the textile shoulder strap outer layer. Folds 19 are also provided.

Figure 6:
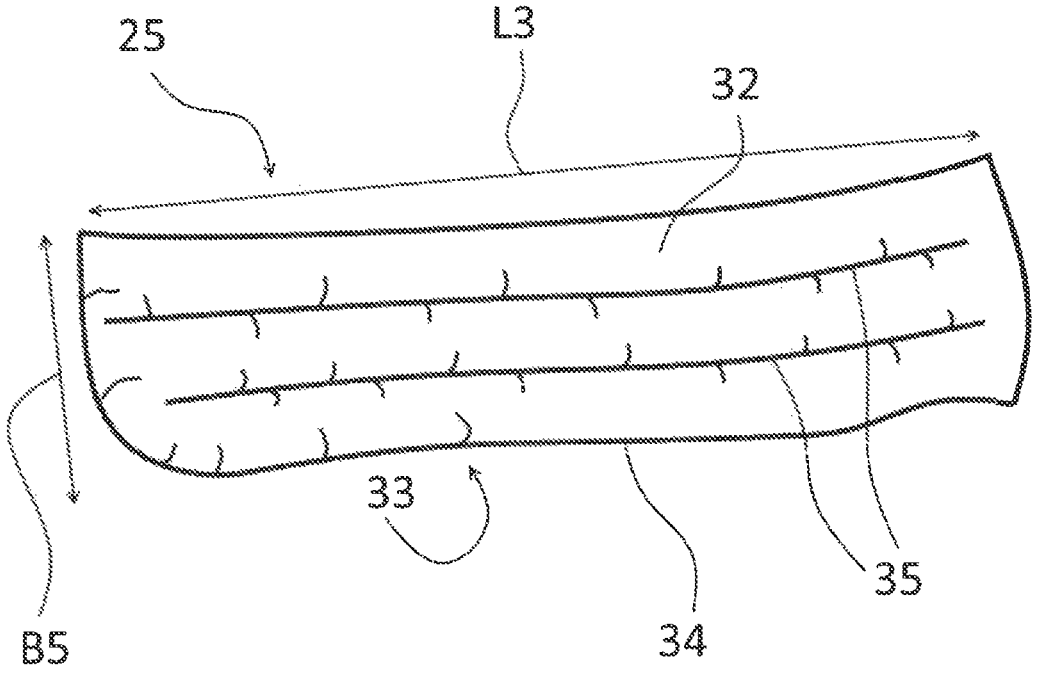
FIG. 6 shows an embodiment of the cushion.

FIG. 6 shows the cushion 25 with a first cushion side 32 and an opposite second cushion side 33, wherein the first and second cushion side 32, 33 are connected on a circumferential cushion edge 34 by a first cushion seam. Here, at least one second cushion seam 35 connects the first cushion side 32 and the second cushion side 33, wherein this second cushion seam 35 extends from a section or from a direction of a section of the circumferential cushion edge 34 through to the opposite section or in the direction of the opposite section of the circumferential cushion edge 34, for example wherein the second cushion seam 35 punctures the cushion material, in some cases in contrast to the first cushion seam. The cushion has a cushion length L3 and a cushion width B5.

Figure 7:
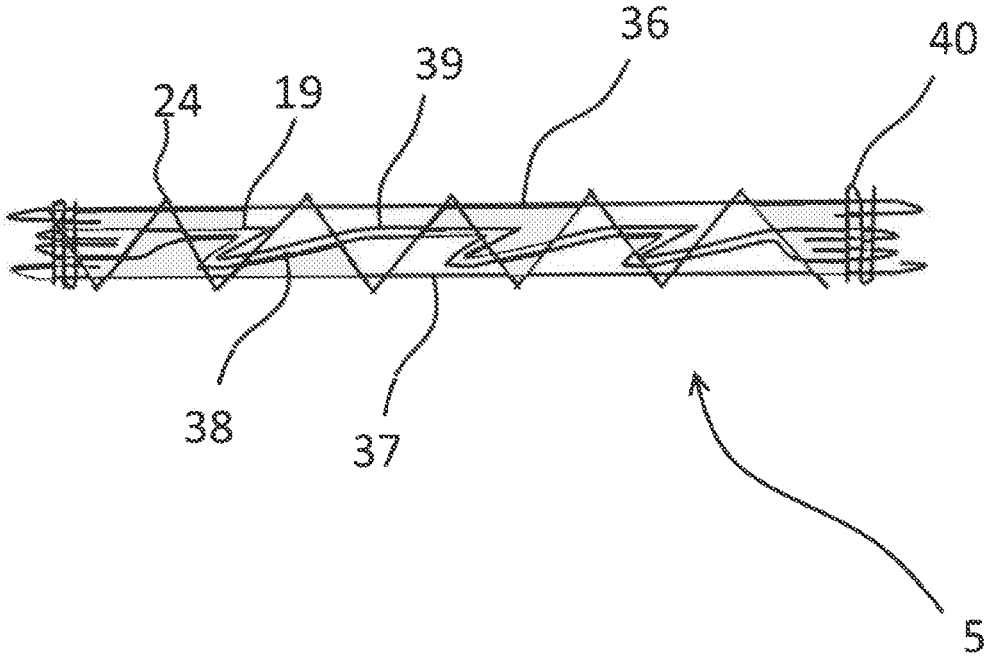
FIG. 7 shows a cross-section through the connecting section along the connecting section seam 24 shown in FIG. 3.

FIG. 7 shows a cross-section through the connecting section 5 along the connecting section seam 24 shown in FIG. 3. The folds between the back textile outer layer 36 and the back textile inner layer 37 in the area of the connecting section can be seen. The edge seam 40 connects the back textile outer layer 36 with the back textile inner layer 37. The connecting section seam 24 stabilizes the Z-shaped fold 19, which is at least partially disposed, for example sewn in, between the back textile inner layer and the back textile outer layer. The Z-shaped fold 19 is formed by the textile shoulder strap outer layer 39 and the textile shoulder strap inner layer 38, which are folded parallel in relation to each other. Here, three Z-shaped folds 19 are present. Only two or even four and more Z-shaped folds have also been shown to be advantageous.

Figure 8:
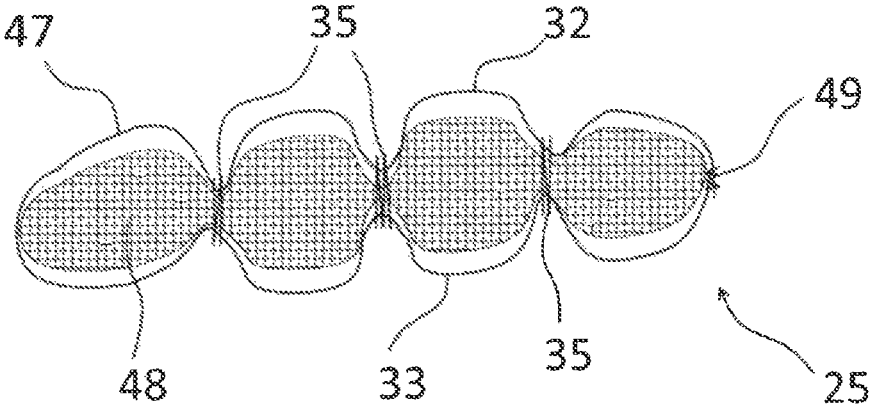
FIG. 8 shows a cross-section through an embodiment of the cushion.

FIG. 8 shows a cross-section through a cushion 25 with a textile shell 47. This is not the cushion shown in FIG. 6, since this has only two essentially parallel second cushion seams 35 and in FIG. 8, three second cushion seams 35 are provided. However, it can in general be constructed in a similar way. Here, it is provided that the second cushion seams 35 connect the first cushion side 32 and the second cushion side 33, wherein the second cushion seam 35 punctures the cushion material 48, in contrast to the first cushion seam 49.

Figure 9:
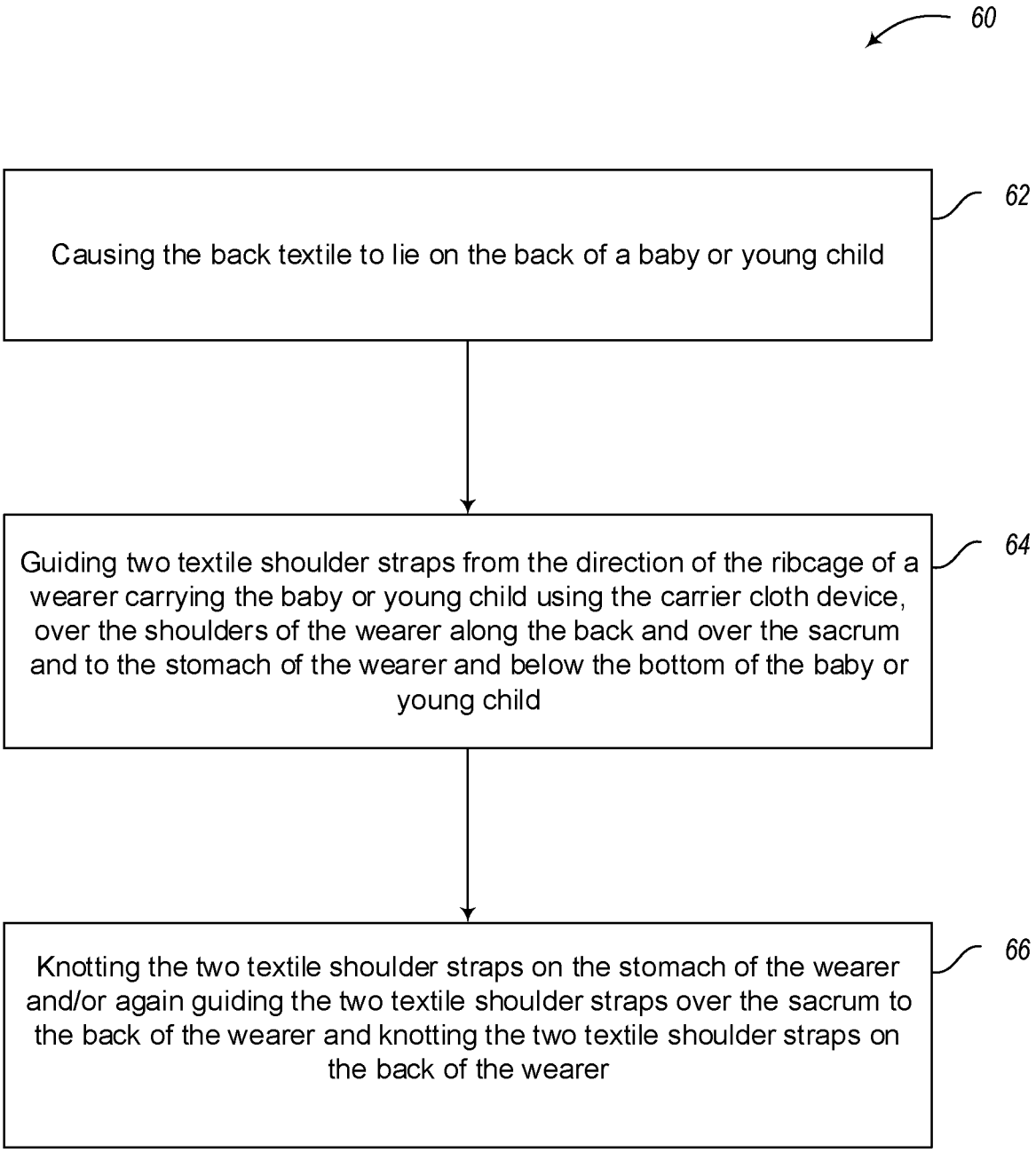
FIG. 9 shows a flow diagram illustrating a method of using a carrier cloth device for transporting babies or young children as described herein.

FIG. 9 is a flow diagram showing a method of using a carrier cloth device for transporting babies or young children as described herein. The method includes steps of causing the back textile of the carrier cloth device to lie on the back of the baby or young child, guiding two textile shoulder straps from the direction of the ribcage of a wearer carrying the baby or young child using the carrier cloth device over the shoulders of the wearer along the back and over the sacrum and to the stomach of the wearer and below the bottom of the young child, and knotting the two textile shoulder straps on the stomach of the wearer and/or again guiding the two textile shoulder straps over the sacrum to the back of the wearer and knotting the two textile shoulder straps on the back of the wearer.

The features of the present disclosure disclosed in the above description, the claims and the drawings can be essential both individually and in any combination required for the realization of the present disclosure in its different embodiments.

LIST OF REFERENCE NUMERALS

1 Carrier cloth device
2 Back textile

3 Cushion pouches
4 Textile shoulder strap
5 Connecting section
6 Head support belt
7 Hip belt
8 Hip belt reinforcement
9 Back textile inner side
10 Textile shoulder strap inner side, such as the textile shoulder strap inner layer
11 Back textile outer side
12 Textile shoulder strap outer side, such as the textile shoulder strap outer layer
13 Head support
14 Ends of the textile shoulder strap
15 Pouch seam
16 Textile tunnel
17 Closure means
18 Closure means counterpiece
19 Z-fold
20 Textile strip
21 Closing loop
22 Rounded corner
23 Non-rounded corners
24 Connecting section seams of the connecting section 5
25 Cushion
26 Non-rounded corner
27 Slit seams orthogonal to the slit
28 Pouch opening
29 First opening edge
30 Second opening edge
31 Slit seams essentially parallel to the slit
32 First cushion side
33 Second cushion side
34 Circumferential cushion edge
35 Second cushion seam
36 Back textile outer layer
37 Back textile inner layer
38 Textile shoulder strap inner layer
39 Textile shoulder strap outer layer
40 Edge seam
41 Separation, such as separating seam
42 Inner shoulder strap edge
43 Outer shoulder strap edge
44 First strap section
45 Second strap section
46 Pouch wall
47 Textile shell of the cushion
48 Cushion material, such as foam
49 First cushion seam
50 Third strap section
B1 First width in the first strap section
B2 Second width in the second strap section
B3 Third width in the third strap section
B4 Third width at the end of the textile shoulder strap
B5 Cushion width
L1 Length of the second strap section
L2 Slit length
L3 Cushion length The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A carrier cloth device for babies or young children, comprising:

a back textile with a back textile inner side and a back textile outer side;

two textile shoulder straps, with a textile shoulder strap inner side and an opposite textile shoulder strap outer side, respectively; and at least two cushions, wherein the two textile shoulder straps are each connected to the back textile and comprise at least one cushion pouch with a pouch opening, respectively, wherein the respective cushion pouch is designed and configured to hold at least one of the at least two cushions, and wherein each cushion is insertable into the respective cushion pouch through the respective pouch opening and is removable from said cushion pouch, and wherein the pouch opening is formed in the textile shoulder strap outer side or is formed in the textile shoulder strap inner side or is formed between the textile shoulder strap outer side and the textile shoulder strap inner side, wherein the two textile shoulder straps have a textile shoulder strap inner layer and an opposite textile shoulder strap outer layer, respectively, and wherein the textile shoulder strap inner layer comprises the textile shoulder strap inner side and the textile shoulder strap outer layer comprises the textile shoulder strap outer side, wherein the cushion pouches have at least one pouch wall, which is formed by the textile shoulder strap inner layer and/or the textile shoulder strap outer layer, wherein the pouch opening is formed b a slit with a slit length, and wherein the slit is formed entirely or partially by a textile, which has an inherent first expandability and/or first elasticity in a first direction and an inherent second expandability and/or second elasticity in a second direction wherein the second expandability and/or second elasticity is less than the first expandability and/or first elasticity, and wherein the textile forming the slit is oriented such that the slit has a maximum longitudinal extension in the first direction.

2. The carrier cloth device for babies or young children according to claim 1, wherein the back textile inner side is formed by a back textile inner layer and the back textile outer side is formed by a back textile outer layer, wherein the back textile comprises at least one connecting section with which the two textile shoulder straps are connected, and wherein the two textile shoulder straps extend into the at least one connecting section of the back textile and have there at least one Z-shaped fold, which is at least partially disposed between the back textile inner layer and the back textile outer layer.

3. The carrier cloth device for babies or young children according to claim 1, wherein the two textile shoulder straps each have a first strap section in which the textile shoulder strap is connected with the back textile, wherein the first strap section has at least one fold, and the two textile shoulder straps each have a second strap section in which the textile shoulder strap has one average and/or constant width, and wherein the cushion pouch is present in said second strap section, respectively.

4. The carrier cloth device for babies or young children according to claim 1, wherein the pouch opening of the two textile shoulder straps has a first and second opening edge, respectively, wherein the first opening edge is formed by a turned over section of the textile shoulder strap outer layer or of the textile shoulder strap inner layer, and the second opening edge is formed by a turned over section of the textile shoulder strap inner layer or of the textile shoulder strap outer layer.

5. The carrier cloth device for babies or young children according to claim 1, wherein the cushions each have a cushion length and a cushion width, wherein the cushion width is less than the cushion length and more than the slit length of the slit of the pouch opening.

6. The carrier cloth device for babies or young children according to claim 1, wherein the pouch opening is formed in the textile shoulder strap outer side or is formed between the textile shoulder strap outer side and the textile shoulder strap inner side.

7. The carrier cloth device for babies or young children according to claim 1, wherein the two textile shoulder straps have an inner shoulder strap edge and an outer shoulder strap edge, wherein the textile shoulder strap inner side and the textile shoulder strap outer side extend between the inner shoulder strap edge and the outer shoulder strap edge, wherein, in normal use of the textile shoulder strap, the inner shoulder strap edge is positioned closer to the neck of the wearer than the outer shoulder strap edge, wherein the pouch opening is present on the inner shoulder strap edge and/or wherein the textile shoulder strap inner side is connected as a single piece with the textile shoulder strap outer side.

8. The carrier cloth device for babies or young children according to claim 1, wherein the textile shoulder straps each comprise a textile strip which extends essentially parallel to the cushion pouch and which has an average width of at least 2 cm.

9. The carrier cloth device for babies or young children according to claim 1, wherein the cushion pouches and/or the cushions have an essentially rectangular form with four corners, wherein one or two of the corners are more strongly rounded than the remaining corners.

10. The carrier cloth device for babies or young children according to claim 1, wherein the pouch opening consists predominantly or solely of textile materials and/or has a maximum longitudinal extension which extends essentially parallel to the longitudinal extension of the shoulder strap, and/or that the cushion comprises a textile shell surrounding a cushion material.

11. The carrier cloth device for babies or young children according to claim 1, wherein the cushions each comprise a first cushion side and an opposite second cushion side, wherein the first and second cushion side are connected on a circumferential cushion edge by a first cushion seam, and wherein at least one second cushion seam connects the first cushion side and the second cushion side and this second cushion seam extends from a section of the circumferential cushion edge through to the opposite section or in the direction of the opposite section of the circumferential cushion edge.

12. The carrier cloth device for babies or young children according to claim 1, wherein the carrier cloth device is a stomach and back carrier cloth device.

13. The carrier cloth device for babies or young children according to claim 3, wherein the first strap section extends into the at least one connecting section of the back textile and has there has at least one Z-shaped fold which is at least partially disposed between the back textile inner layer and the back textile outer layer.

14. The carrier cloth device for babies or young children according to claim 3, wherein the textile shoulder straps have a constant second width throughout the second strap section.

15. The carrier cloth device for babies or young children according to claim 1, wherein the cushion pouches are bounded by, aside from the pouch openings, entirely or partially circumferential pouch seams which connect the textile shoulder strap inner layer and the textile shoulder strap outer layer.

16. The carrier cloth device for babies or young children according to claim 4, wherein the first opening edge is formed by a turned over section of the textile shoulder strap outer layer and the second opening edge is formed by a turned over section of the textile shoulder strap outer layer or of the textile shoulder strap inner layer.

17. The carrier cloth device for babies or young children according to claim 4, wherein the slit length is defined by slit seams and/or wherein said slit seams run orthogonally to the slit.

18. The carrier cloth device for babies or young children according to claim 6, wherein the two textile shoulder straps each have a textile shoulder strap inner layer and an opposite textile shoulder strap outer layer, wherein the pouch openings are each formed in the textile shoulder strap outer side or are each formed between the textile shoulder strap inner layer and the textile shoulder strap outer layer, and wherein the textile shoulder strap inner layer comprises the textile shoulder strap inner side and the textile shoulder strap outer layer comprises the textile shoulder strap outer side.

19. The carrier cloth device for babies or young children according to claim 7, wherein the textile shoulder strap inner layer is connected as a single piece on the inner shoulder strap edge with the textile shoulder strap outer layer.

20. The carrier cloth device for babies or young children according to claim 8, wherein the textile shoulder straps have an average width in a range from 3.5 to 7 cm and/or wherein said textile strip forms a section of an outer shoulder strap edge.

21. The carrier cloth device for babies or young children according to claim 9, wherein the cushion pouches and/or the cushions have an essentially rectangular form with four corners, wherein one or two more strongly rounded corners of the cushion pouch are disposed closer to an outer shoulder strap edge than to the inner shoulder strap edge.

22. The carrier cloth device for babies or young children according to claim 10, wherein the textile shell is formed at least in sections from the same material as the carrier cloth device.

23. The carrier cloth device for babies or young children according to claim 11, wherein the second cushion seam punctures the cushion material.

24. A method of using a carrier cloth device according to claim 1 for transporting babies or young children, comprising:

causing the back textile to lie on the back of a baby or young child, guiding two textile shoulder straps from the direction of the ribcage of a wearer carrying the baby or young child using the carrier cloth device, over the shoulders of the wearer along the back and over the sacrum and to the stomach of the wearer and below the bottom of the baby or young child, and knotting the two textile shoulder straps on the stomach of the wearer and/or again guiding the two textile shoulder straps over the sacrum to the back of the wearer and knotting the two textile shoulder straps on the back of the wearer.

* * * * *